US010893366B1

(12) United States Patent
Yang

(10) Patent No.: US 10,893,366 B1
(45) Date of Patent: Jan. 12, 2021

(54) AUDIO DEVICE WITH DYNAMIC MICROPHONE AND SPEAKER

(71) Applicant: Shenzhen Hua Sirui Technology Co. Ltd, Shenzhen (CN)

(72) Inventor: Bing Yang, Shenzhen (CN)

( * ) Notice: Subject to any disclaimer, the term of this patent is extended or adjusted under 35 U.S.C. 154(b) by 0 days.

(21) Appl. No.: 16/736,732

(22) Filed: Jan. 7, 2020

(51) Int. Cl.

| | |
|---|---|
| ***H04R 1/02*** | (2006.01) |
| ***H04R 7/26*** | (2006.01) |
| ***H04R 1/04*** | (2006.01) |
| ***H04R 1/28*** | (2006.01) |
| ***H04R 3/00*** | (2006.01) |
| ***H04R 7/18*** | (2006.01) |
| ***H04R 1/08*** | (2006.01) |

(52) U.S. Cl.
CPC ..... *H04R 7/26* (2013.01); *H04R 1/025* (2013.01); *H04R 1/04* (2013.01); *H04R 1/086* (2013.01); *H04R 1/2834* (2013.01); *H04R 3/00* (2013.01); *H04R 7/18* (2013.01)

(58) Field of Classification Search
CPC ... H04R 1/02; H04R 1/04; H04R 1/08; H04R 1/025; H04R 1/086; H04R 1/14; H04R 1/28; H04R 1/2807; H04R 1/2834; H04R 1/2865; H04R 3/00; H04R 7/26; H04R 7/118; G10H 1/36
See application file for complete search history.

(56) References Cited

U.S. PATENT DOCUMENTS

| | | | | |
|---|---|---|---|---|
| 5,349,480 A * | 9/1994 | Takao | G10H 1/361 360/1 |
| 5,383,079 A * | 1/1995 | Takao | G11B 25/06 360/1 |
| 10,504,497 B2 * | 12/2019 | You | H04N 21/8113 |
| 2018/0332387 A1 * | 11/2018 | You | H04B 1/20 |

FOREIGN PATENT DOCUMENTS

| | | |
|---|---|---|
| CN | 109275053 A * | 1/2019 |
| CN | 110166886 A * | 8/2019 |
| TW | M535921 U * | 1/2017 |

* cited by examiner

*Primary Examiner* — Thang V Tran
(74) *Attorney, Agent, or Firm* — Novoclaims Patent Services LLC; Mei Lin Wong

(57) ABSTRACT

An audio device includes a casing, a handle frame downwardly extended from a bottom side of the casing, a speaker assembly and a PCB board are received in the casing, and a microphone supported on the casing in a dynamic manner for preventing a vibration of the casing directly transmitted to the microphone. The microphone and the speaker assembly are electrically connected to the PCB board, such that the speaker assembly is adapted for instantly play back a sound signal collected by the microphone. The audio device of the present invention has an advantages of high impedance, good sound quality, and strong omni-directional ability, such that the electro-acoustic conversion effect and overall performance of the audio device is enhanced. At the same time, the audio device has a built-in speaker to instantly play back the sound collected by the microphone so as to fulfill different applications.

4 Claims, 6 Drawing Sheets

AUDIO DEVICE WITH DYNAMIC MICROPHONE AND SPEAKER

BACKGROUND OF THE PRESENT INVENTION

Field of Invention

The present invention relates a microphone, and more particularly to an audio device with a dynamic microphone and speaker.

Description of Related Arts

A microphone is an audio device for receiving a sound signal and converting the sound signal into an electrical signal. Accordingly, different types of microphone and different qualities of microphone directly affect the electro-acoustic conversion result. There are two mainly types of conventional microphone, which are electromagnetic and capacitive microphones, wherein their electro-acoustic conversion powers and microphone impedance cannot meet the requirements. At the same time, the conventional microphone does not provide any photoelectric indicating function to meet the market demand. Further, the conventional microphone comprises an audio receiver directly coupled in a handle frame in a stationary immovable manner, wherein there is no buffering element provided between the audio receiver and the handle frame, such that any unwanted noise, such as a background noise, will also be collected by the audio receiver. Therefore, the conventional microphone cannot provide a high sound quality.

SUMMARY OF THE PRESENT INVENTION

In order to solve the above technical problems, an objective of the present invention is to provide an audio device with a dynamic microphone and speaker, which has an advantages of high impedance, good sound quality, and strong omni-directional ability, such that the electro-acoustic conversion effect and overall performance of the audio device of the present invention can be enhanced.

In order to achieve the above objective, the present invention provides:

an audio device, comprising a casing, a handle frame downwardly extended from a bottom side of the casing, a microphone cover coupled at an upper side of the casing, a microphone received in the microphone cover, a speaker assembly and a PCB board received in the casing, wherein the microphone and the speaker assembly are electrically connected to the PCB board, wherein the microphone is arranged for sound collection to transmit to the PCB board while the speaker assembly is arranged for sound play back from the PCB board, wherein the microphone is supported on the casing in a dynamic manner for preventing a vibration of the casing being directly transmitted to the microphone.

Preferably, the audio device further comprises a LED display unit provided at a lateral side of the casing and electrically connected to the PCB board.

Preferably, the audio device further comprises a microphone supporter coupled at the casing, wherein the microphone supporter is extended through the upper side of the casing and is coupled to the microphone.

Preferably, the microphone supporter comprises an outer supporting ring, an inner supporting ring disposed within the outer supporting ring to define a circumferential gap between the outer supporting ring and the inner supporting ring, and a plurality of ring connectors spacedly disposed at the circumferential gap to retain the inner supporting ring being encircled within the outer supporting ring.

Preferably, the outer supporting ring, the inner supporting ring and the ring connectors are integrally formed to form a one piece integrated member which is made of shock absorbing material.

Preferably, a height of the inner supporting ring is larger than a height of the outer supporting ring, wherein a top end of the inner supporting ring is protruded above the outer supporting ring.

Preferably, the microphone supporter further has at least a wire extending slot formed at the inner supporting ring for a connecting wire extending therethrough to connect to the microphone.

Preferably, the microphone supporter further has a receiving indentation formed at a bottom side of the inner supporting ring to communicate with the wire extending slot.

Preferably, the speaker assembly 5 comprises a speaker electrically connected to the PCB board.

Preferably, the speaker assembly further comprises a diaphragm support coupled at a back side of the speaker, and a passive diaphragm film coupled at the diaphragm support.

The audio device of the present invention has an advantages of high impedance, good sound quality, and strong omni-directional ability, such that the electro-acoustic conversion effect and overall performance of the audio device of the present invention can be enhanced. At the same time, the audio device has a built-in speaker to instantly play back the sound collected by the microphone so as to fulfill different needs or different applications.

DETAILED DESCRIPTION OF THE PREFERRED EMBODIMENT

The present invention will be described from the following accompanying drawings, and the specific embodiments.

Figure 1:
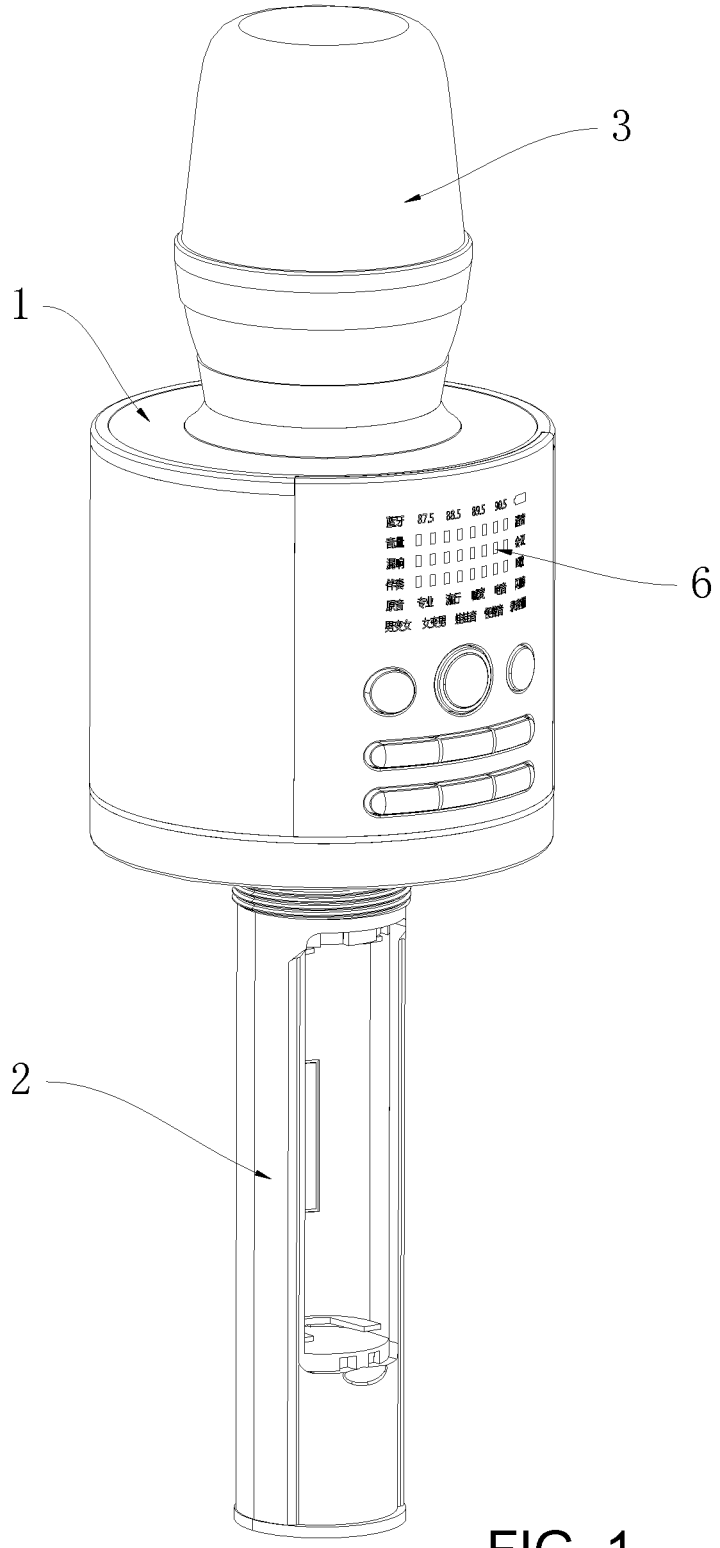
FIG. 1 is a perspective view of an audio device with a dynamic microphone and speaker according to a preferred embodiment of the present invention.
Figure 2:
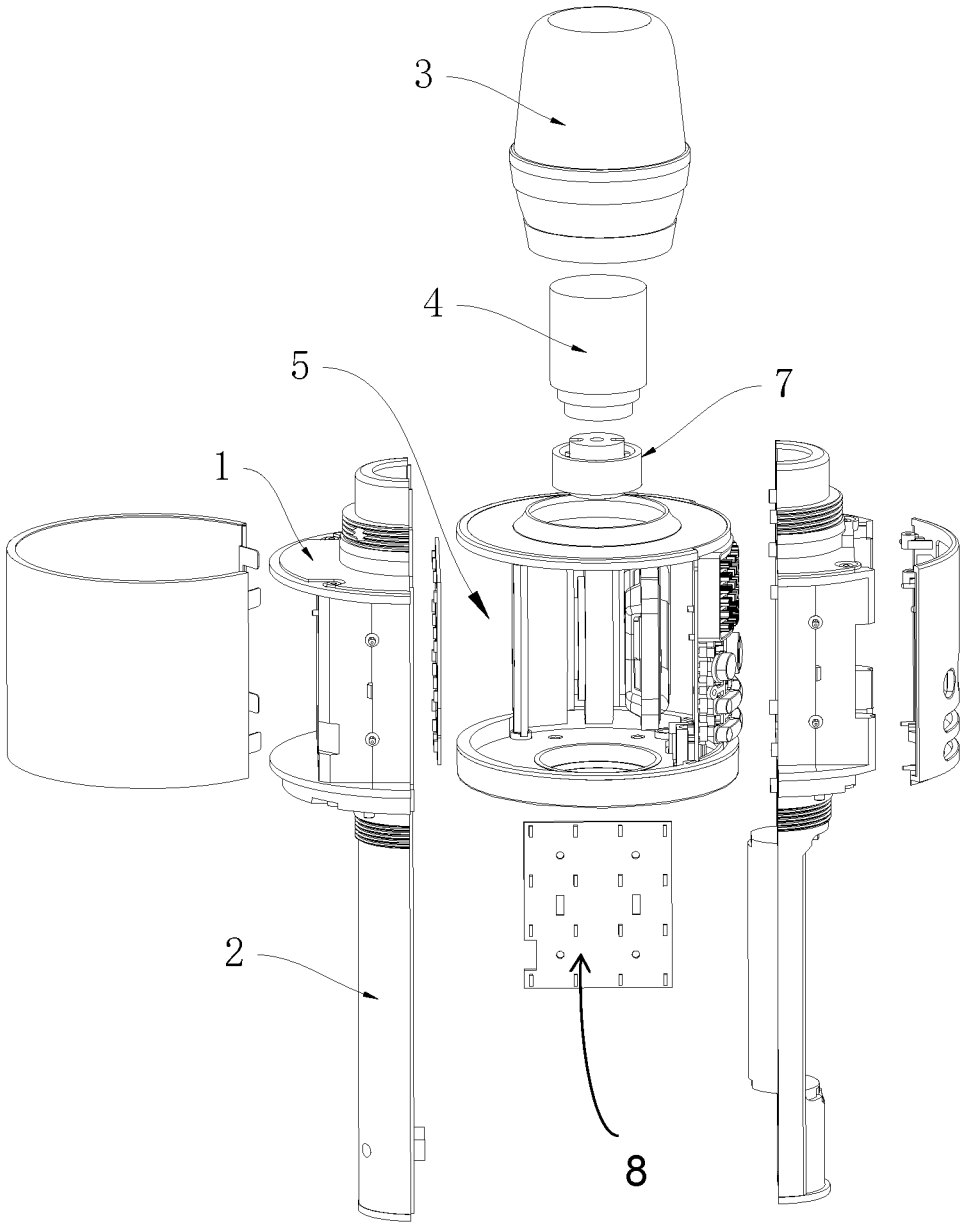
FIG. 2 is an exploded perspective view of the audio device with the dynamic microphone and speaker according to the above preferred embodiment of the present invention.
Figure 3:
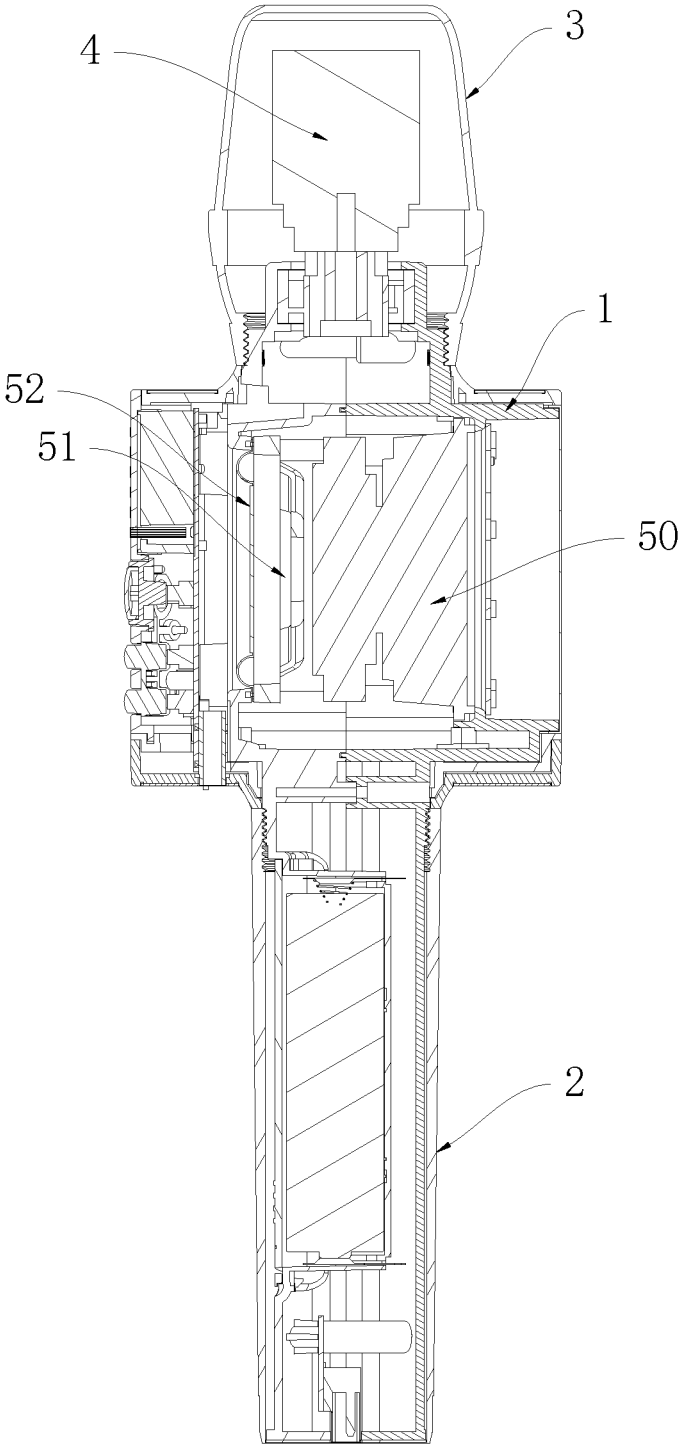
FIG. 3 is a sectional view of the audio device with the dynamic microphone and speaker according to the above preferred embodiment of the present invention.
Figure 4:
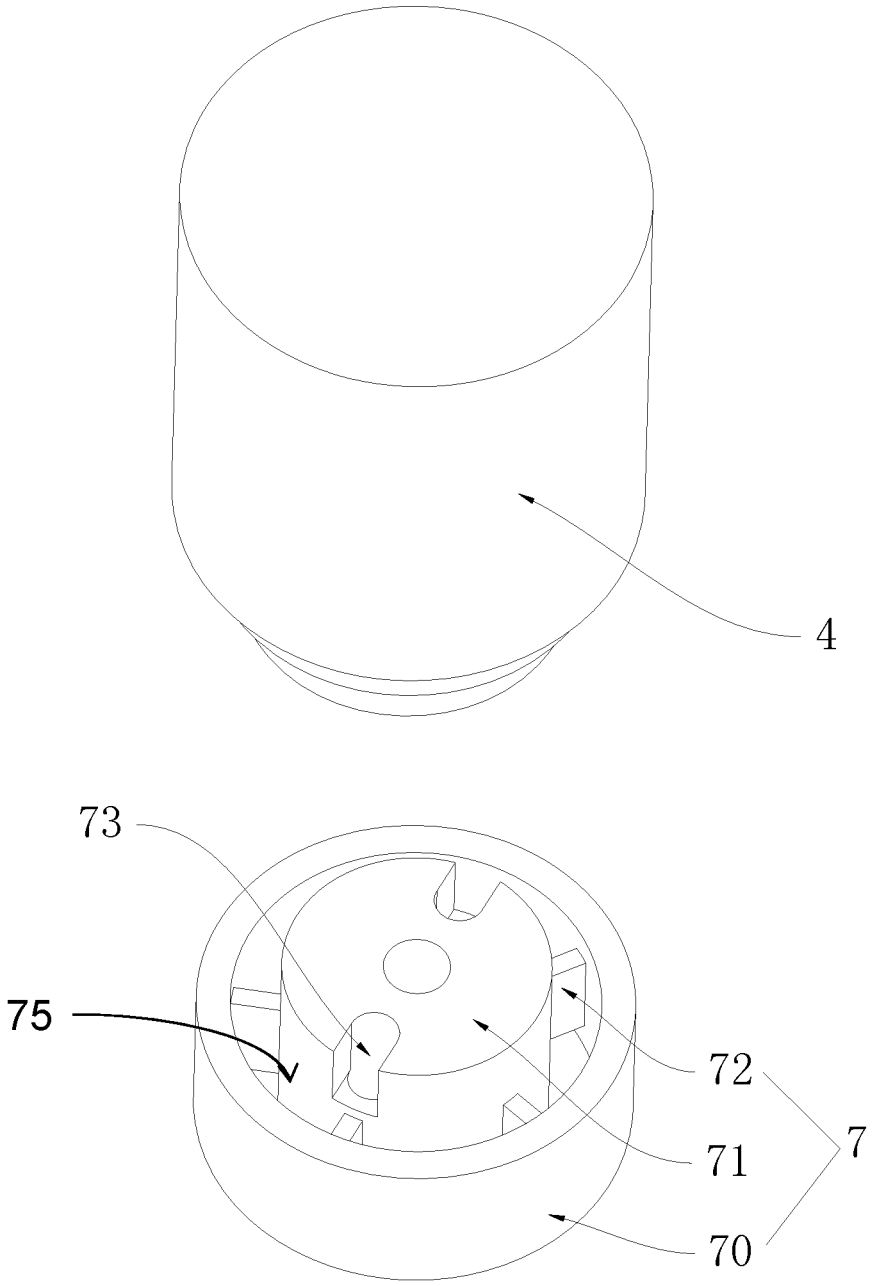
FIG. 4 is an exploded perspective view of the microphone coupled to the casing via the microphone supporter according to the above preferred embodiment of the present invention.
Figure 5:
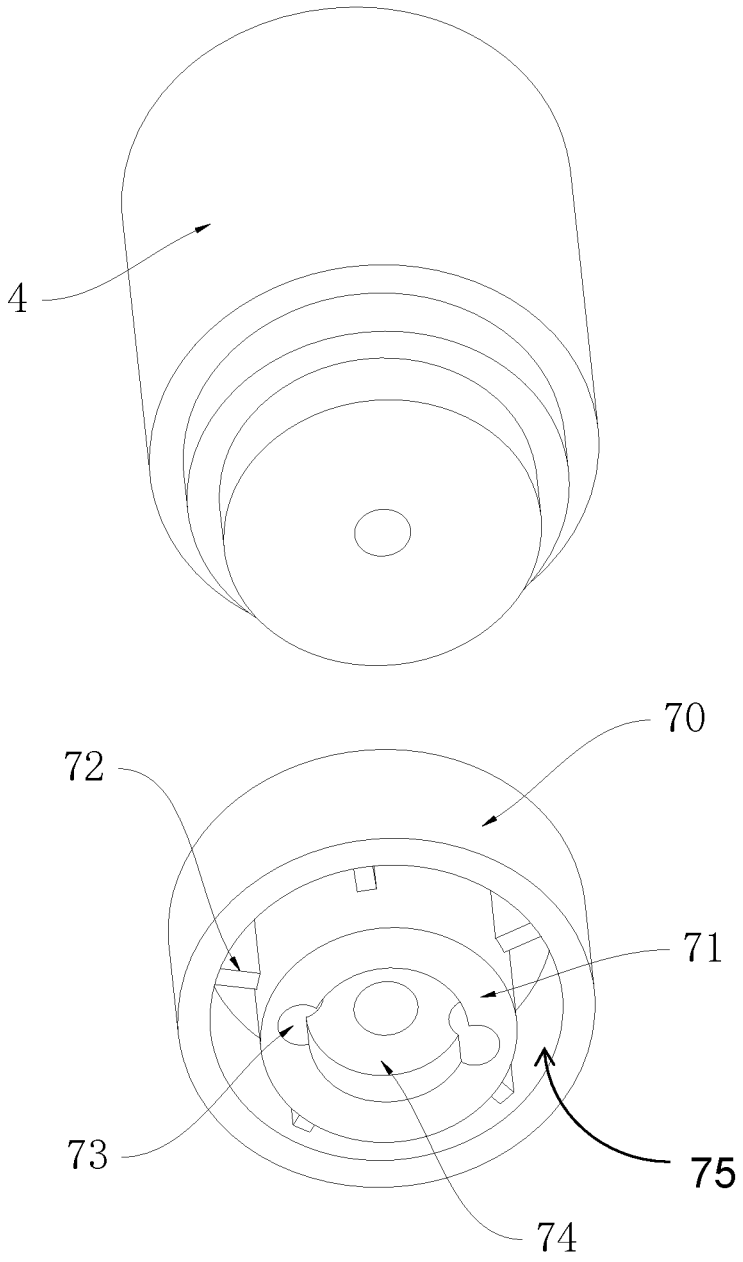
FIG. 5 is another exploded perspective view of the microphone coupled to the casing via the microphone supporter according to the above preferred embodiment of the present invention.
Figure 6:
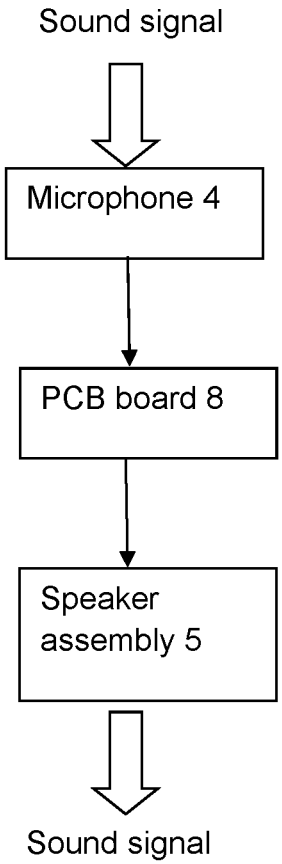
FIG. 6 illustrates the sound signal being collected by the microphone and instantly played back by the speaker assembly of the audio device according to the above preferred embodiment of the present invention.

As shown in FIG. 1 to FIG. 5, an audio device according to a preferred embodiment of the present invention is illustrated, wherein the audio device comprises a casing 1, a handle frame 2 downwardly extended from a bottom side of the casing 1, a microphone cover 3 coupled at an upper side of the casing 1, a microphone 4 received in the microphone cover 3, a speaker assembly 5 and a PCB board 8 received in the casing 1. The microphone 4 and the speaker assembly 5 are electrically connected to the PCB board 8, wherein the microphone 4 is arranged for sound collection to transmit to the PCB board 8 while the speaker assembly 5 is arranged for sound play back from the PCB board 8. According to the preferred embodiment, the microphone 4 is supported on the casing in a dynamic manner to allow the microphone 4 being slightly moved with respect to the casing 1 for preventing a vibration of the casing 1 being directly transmitted to the microphone 4. In other words, the speaker assembly is able to instantly output a sound signal collected by the microphone through the PCB board 8.

According to the preferred embodiment, the microphone 4 as the dynamic microphone has an advantages of high impedance, good sound quality, and strong omni-directional ability, such that the electro-acoustic conversion effect and overall performance of the audio device of the present invention will be enhanced. Furthermore, the speaker assembly 5 is provided in the casing 1, wherein under the control of the PCB board 8, the sound can be played back by the speaker assembly 5 at the same time when the sound is collected by the microphone 4 so as to meet different requirements.

For a display purpose, the audio device further comprises a display unit 6 provided at a lateral side of the casing 1 and electrically connected to the PCB board 8. Preferably, the display unit 6 is a LED display unit incorporating with a LED indicating light. Alternatively, the display unit 6 can be a digital screen or the like.

In order to support the microphone 4, the audio device further comprises a microphone supporter 7 coupled at the casing 1, wherein the microphone supporter 7 is extended through the upper side of the casing 1. The microphone 4 is movably coupled to microphone supporter 7 so as to support the microphone 4 above the casing 1. Accordingly, the microphone supporter 7 is arranged for absorbing the vibration from the casing 1 to prevent the vibration directly transmitted to the microphone 4.

According to the preferred embodiment, the microphone supporter 7 comprises an outer supporting ring 70 coupled at the casing 1, an inner supporting ring 71 disposed within the outer supporting ring 70 to define a circumferential gap between the outer supporting ring and the inner supporting ring 71, and a plurality of ring connectors 72 spacedly disposed at the circumferential gap to retain the inner supporting ring 71 being encircled within the outer supporting ring 70. In other words, each of the ring connectors 72 is extended radially and has an inner end biased against an outer circumferential surface of the inner supporting ring 71 and an outer end biased against an inner circumferential surface of the outer supporting ring 70. Preferably, the inner supporting ring 71 is coaxially supported within the outer supporting ring 70 via the ring connectors 72. Accordingly, at least one of the outer supporting ring 70, the inner supporting ring 71 and the ring connectors 72 is made of shock absorbing material such as soft rubber material. In one example, the ring connectors 72 re made of shock absorbing material. For example, the outer supporting ring 70, the inner supporting ring 71 and the ring connectors 72 are individual components, wherein only the ring connectors 72 are made of shock absorbing material such as soft rubber material. Preferably, the outer supporting ring 70, the inner supporting ring 71 and the ring connectors 72 are integrally formed to form a one piece integrated member which is made of shock absorbing material such as soft rubber material. In other words, by dynamically connecting the microphone 4 to the microphone supporter 7, the microphone supporter 7 is made of shock absorbing material that allows a slightly movement of the microphone 4 with respect to the casing 1 by means of dynamic connection and absorbs the vibration from the casing 1.

Accordingly, the outer supporting ring 70 and the inner supporting ring 71 are spaced apart with each other and the ring connectors 72 are formed in the circumferential gap between the outer supporting ring 70 and the inner supporting ring 71 to form the one piece integrated member. Since the microphone supporter 7 is made of shock absorbing material, the microphone supporter 7 provides a buffering function to absorb and/or cancel the vibration and/or impact at the casing 1, so as to ensure the excellent electro-acoustic conversion performance of the microphone 4.

For facilitating the installation of the microphone 4, a height of the inner supporting ring 71 is larger than a height of the outer supporting ring 70, wherein a top end of the inner supporting ring 71 is protruded above the outer supporting ring 70 to couple with the microphone 4.

Furthermore, the microphone supporter 7 further has at least a wire extending slot 73 formed at the inner supporting ring 71 for a connecting wire extending therethrough to connect to the microphone 4. Preferably two wire extending slots 73 are provided at two sides of the inner supporting ring 71 that two connecting wires are guided to extend through the wire extending slots 73 at the inner supporting ring 71 to connect to the microphone 4.

For facilitating the wire storage, sorting, and leading out, in this embodiment, the microphone supporter 7 further has a receiving indentation 74 formed at a bottom side of the inner supporting ring 71 to communicate with the wire extending slot 73. Therefore, an excessive portion of the connecting wire at the bottom side of the inner supporting ring 71 can be organized and received at the receiving indentation 74.

According to the preferred embodiment, the speaker assembly 5 comprises a speaker 50 electrically connected to the PCB board 8.

Furthermore, the speaker assembly 5 further comprises a diaphragm support 51 coupled at a back side of the speaker 50, and a passive diaphragm film 52 coupled at the diaphragm support 51 for outputting the sound signal. Via the action of the passive diaphragm film 52, the sound output of the speaker assembly is greatly improved, so as to highly enhance the sound quality of the audio device of the present invention.

The above description is only the preferred embodiment of the present invention, and is not intended to be limiting. The present invention should include all modifications, equivalent substitutions and improvements made within the spirit and principles of the present invention.

What is claimed is:

1. An audio device, comprising:

a casing;

a handle frame downwardly extended from a bottom side of said casing;

a speaker assembly and a PCB board received in said casing;

a microphone supported on said casing in a dynamic manner for preventing a vibration of said casing directly transmitted to said microphone, wherein said microphone and the speaker assembly are electrically connected to said PCB board, such that said speaker assembly is adapted for instantly play back a sound signal collected by said microphone;

a microphone supporter coupled at an upper side of said casing, wherein said microphone is movably coupled to said microphone supporter, such that said microphone supporter is arranged for absorbing the vibration from said casing to prevent the vibration directly transmitted to said microphone, wherein said microphone supporter comprises an outer supporting ring coupled at said casing, an inner supporting ring disposed within said outer supporting ring to define a circumferential gap between said outer supporting ring and said inner supporting ring, and a plurality of ring connectors spacedly disposed at said circumferential gap to retain said inner supporting ring said being encircled within said outer supporting ring; and said microphone supporter has at least a wire extending slot formed at said inner supporting ring for a connecting wire extending therethrough to connect to said microphone and a receiving indentation formed at a bottom side of said inner supporting ring to communicate with said wire extending slot for receiving an excessive portion of the connecting wire at said bottom side of said inner supporting ring.

2. An audio device, comprising:

a casing;

a handle frame downwardly extended from a bottom side of said casing;

a speaker assembly and a PCB board received in said casing;

a microphone supported on said casing in a dynamic manner for preventing a vibration of said casing directly transmitted to said microphone, wherein said microphone and the speaker assembly are electrically connected to said PCB board, such that said speaker assembly is adapted for instantly play back a sound signal collected by said microphone;

a microphone supporter coupled at an upper side of said casing, wherein said microphone is movably coupled to said microphone supporter, such that said microphone supporter is arranged for absorbing the vibration from said casing to prevent the vibration directly transmitted to said microphone, wherein said microphone supporter is made of shock absorbing material that allows a slightly movement of said microphone with respect to said casing and absorbs the vibration from said casing, wherein said microphone supporter comprises an outer supporting ring coupled at said casing, an inner supporting ring disposed within said outer supporting ring to define a circumferential gap between said outer supporting ring and said inner supporting ring, and a plurality of ring connectors spacedly disposed at said circumferential gap to retain said inner supporting ring said being encircled within said outer supporting ring, wherein a height of said inner supporting ring is larger than a height of said outer supporting ring, wherein a top end of said inner supporting ring is protruded above said outer supporting ring to couple with said microphone, wherein said microphone supporter has at least a wire extending slot formed at said inner supporting ring for a connecting wire extending therethrough to connect to said microphone, wherein said microphone supporter has a receiving indentation formed at a bottom side of said inner supporting ring to communicate with said wire extending slot for receiving an excessive portion of the connecting wire at said bottom side of said inner supporting ring.

3. The audio device, as recited in claim 2, wherein said speaker assembly comprises a speaker electrically connected to said PCB board, a diaphragm support coupled at a back side of said speaker, and a passive diaphragm film coupled at said diaphragm support for outputting the sound signal.

4. The audio device, as recited in claim 3, further comprising a LED display unit provided at a lateral side of said casing and electrically connected to said PCB board, and a microphone cover coupled at an upper side of said casing to receive said microphone in said microphone cover.

* * * * *